US009206733B2

(12) United States Patent
Balsley, II

(10) Patent No.: US 9,206,733 B2
(45) Date of Patent: Dec. 8, 2015

(54) TURBOCHARGER ASSEMBLY WITH DIRECT-MOUNTED BEARING HOUSING

(71) Applicant: GM GLOBAL TECHNOLOGY OPERATIONS LLC, Detroit, MI (US)

(72) Inventor: Richard Lee Balsley, II, Ortonville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 228 days.

(21) Appl. No.: 13/929,910

(22) Filed: Jun. 28, 2013

(65) Prior Publication Data

US 2015/0000272 A1 Jan. 1, 2015

(51) Int. Cl.

| | |
|---|---|
| ***F02B 33/44*** | (2006.01) |
| ***F04B 17/00*** | (2006.01) |
| ***F02B 37/12*** | (2006.01) |
| ***F01D 25/16*** | (2006.01) |

(52) U.S. Cl.

CPC ..... *F02B 37/12* (2013.01); *F01D 25/16* (2013.01); *F05B 2220/40* (2013.01)

(58) Field of Classification Search

CPC ..... F02B 37/12; F01D 25/16; F05B 2220/40
USPC ..... 60/605.3; 417/407; 184/6.11
See application file for complete search history.

(56) References Cited

U.S. PATENT DOCUMENTS

| | | | | |
|---|---|---|---|---|
| 4,716,735 | A * | 1/1988 | Ruf et al. | 60/605.3 |
| 5,402,643 | A * | 4/1995 | Buchanan et al. | 60/605.3 |
| 7,946,118 | B2 * | 5/2011 | Hippen et al. | 60/605.3 |
| 8,826,660 | B2 * | 9/2014 | Gockel et al. | 60/605.3 |
| 2010/0050632 | A1 * | 3/2010 | Vuk | 60/605.1 |
| 2010/0139270 | A1 * | 6/2010 | Koch et al. | 60/605.3 |
| 2010/0223911 | A1 * | 9/2010 | Gockel et al. | 60/280 |
| 2011/0302920 | A1 * | 12/2011 | Cuniberti et al. | 60/605.3 |
| 2012/0318229 | A1 * | 12/2012 | Obenaus | 123/193.3 |

* cited by examiner

*Primary Examiner* — Thai Ba Trieu
*Assistant Examiner* — Vikansha Dwivedi
(74) *Attorney, Agent, or Firm* — Quinn Law Group, PLLC

(57) ABSTRACT

A turbocharger pressurizes an airflow for delivery to an internal combustion engine having a cylinder block, a cylinder head, and an oil supply passage formed in at least one of the cylinder block and the cylinder head. The turbocharger includes a bearing housing having a mounting flange for direct mounting to one of the cylinder block and the cylinder head to thereby establish fluid communication with the oil supply passage. The bearing housing also includes a journal bearing, a thrust bearing assembly, and a rotating assembly. The mounting flange defines an oil feed opening configured to correspond to an oil supply passage in one of the cylinder block and the cylinder head and to direct oil to the journal bearing and the thrust bearing assembly when the mounting flange is attached to the engine. An internal combustion engine employing such a turbocharger is also disclosed.

18 Claims, 5 Drawing Sheets

TURBOCHARGER ASSEMBLY WITH DIRECT-MOUNTED BEARING HOUSING

TECHNICAL FIELD

The present disclosure relates to a turbocharger assembly having a direct-mounted bearing housing.

BACKGROUND

Internal combustion engines (ICE) are often called upon to generate considerable levels of power for prolonged periods of time on a dependable basis. Many such ICE assemblies employ a supercharging device, such as an exhaust gas turbine driven turbocharger, to compress the airflow before it enters the intake manifold of the engine in order to increase power and efficiency.

Specifically, a turbocharger is a centrifugal gas compressor that forces more air and, thus, more oxygen into the combustion chambers of the ICE than is otherwise achievable with ambient atmospheric pressure. The additional mass of oxygen-containing air that is forced into the ICE improves the engine's volumetric efficiency, allowing it to burn more fuel in a given cycle, and thereby produce more power.

A typical turbocharger includes a central shaft that is supported by one or more bearings and that transmits rotational motion between an exhaust-driven turbine wheel and an air compressor wheel. Both the turbine and compressor wheels are fixed to the shaft, which in combination with various bearing components constitute the turbocharger's rotating assembly.

Because the rotating assembly frequently operates at speeds over 100,000 revolutions per minute (RPM) and absorbs significant amount of heat from the engine's exhaust gasses whose temperature may approach 2,000 degrees Fahrenheit, cooling of the turbocharger bearings is essential for long term durability of the turbocharger. To thus cool the turbocharger bearings, water and oil are typically supplied to the rotating assembly.

SUMMARY

One embodiment of the disclosure is directed to a turbocharger assembly for pressurizing an airflow for delivery to an internal combustion engine having a cylinder block and a cylinder head. The turbocharger assembly includes a bearing housing having a mounting flange for direct mounting to one of the cylinder block and the cylinder head. The turbocharger assembly also includes a journal bearing disposed along an axis within a bore of the bearing housing. The turbocharger assembly also includes a rotating assembly supported by the journal bearing and configured to be rotated about the axis by the post-combustion gasses. The turbocharger assembly additionally includes a thrust bearing assembly configured to absorb thrust forces generated by the rotating assembly when the airflow is being pressurized. The mounting flange defines an oil feed opening configured to correspond to an oil supply passage in at least one of the cylinder block and the cylinder head and to direct oil to the journal bearing and the thrust bearing assembly when the mounting flange is attached to one of the cylinder block and the cylinder head.

The turbocharger rotating assembly may include a shaft having a first end and a second end, the shaft being supported by the journal bearing for rotation about the axis. The turbocharger rotating assembly may also include a turbine wheel fixed to the shaft proximate to the first end and configured to be rotated about the axis by the post-combustion gasses. The turbocharger rotating assembly may additionally include a compressor wheel fixed to the shaft proximate to the second end and configured to pressurize the airflow being received from the ambient for delivery to the cylinder.

The turbine wheel may be disposed inside a turbine housing having a turbine scroll, while the compressor wheel may be disposed inside a compressor cover having a compressor scroll. In such a case, each of the compressor scroll and the turbine scroll may be attached to the bearing housing.

The turbocharger assembly may additionally include an exhaust connector pipe configured to direct the post-combustion gasses from the cylinder head to the turbine scroll.

The cylinder head may include an integrated exhaust manifold having a mounting surface. In such a case, the exhaust connector pipe may be configured to attach to the cylinder head at the mounting surface.

The exhaust connector pipe may include a flexible coupling configured to take up vibration and positioning variance between the cylinder head and the turbine scroll.

The flexible coupling may define a plurality of apertures configured to accept fasteners for attachment of the turbocharger assembly to one of the cylinder block and the cylinder head.

The flexible coupling may be configured as one of a corrugated pipe and a mesh sleeve, each of which may be structured from a stainless steel.

The engine may additionally include a coolant supply passage, a coolant pump configured to pressurize coolant, and an oil pump configured to pressurize the oil. The bearing housing may include a coolant or water jacket arranged proximate to each of the journal bearing and the thrust bearing assembly. The mounting flange may additionally define a coolant feed opening configured to match up to the coolant supply passage when the mounting flange is attached to one of the cylinder block and the cylinder head and supply the coolant to the coolant jacket. The pressurized oil may be directed to the bearing housing via the oil supply passage to lubricate the journal bearing and the thrust bearing assembly. The coolant may be directed to the bearing housing via the coolant supply passage to absorb and remove heat from the oil that lubricates the journal bearing and the thrust bearing assembly.

The mounting flange may define a plurality of apertures configured to accept fasteners for attachment of the bearing housing to one of the cylinder block and the cylinder head.

Furthermore, the bearing housing may be formed from an aluminum alloy.

Another embodiment of the present disclosure is directed to an internal combustion engine having the turbocharger as described above.

The above features and advantages, and other features and advantages of the present disclosure, will be readily apparent from the following detailed description of the embodiment(s) and best mode(s) for carrying out the described invention when taken in connection with the accompanying drawings and appended claims.

DETAILED DESCRIPTION

Figure 1:
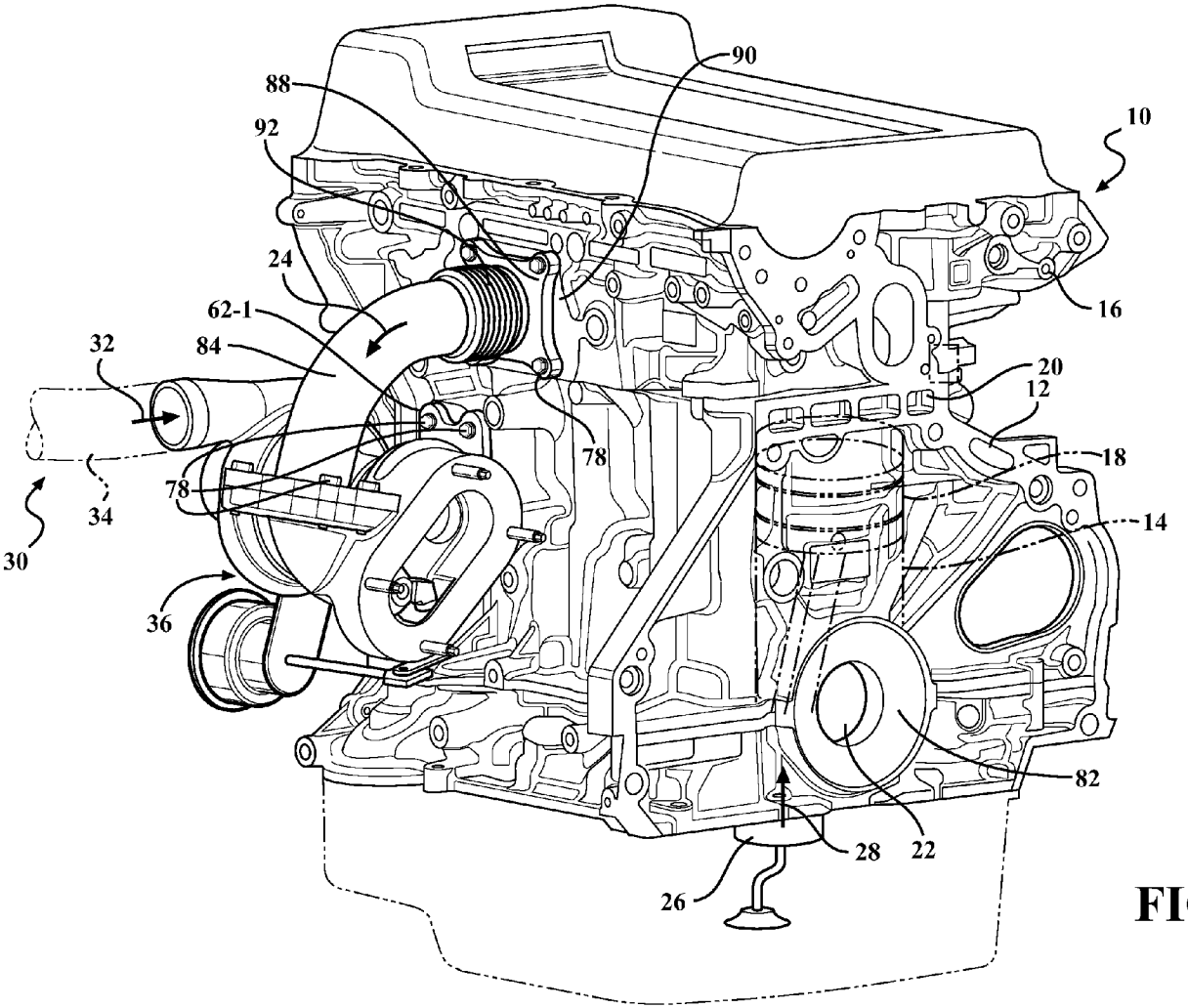
FIG. 1 is a perspective view of an engine with a turbocharger according to an embodiment of the disclosure.
Figure 5:
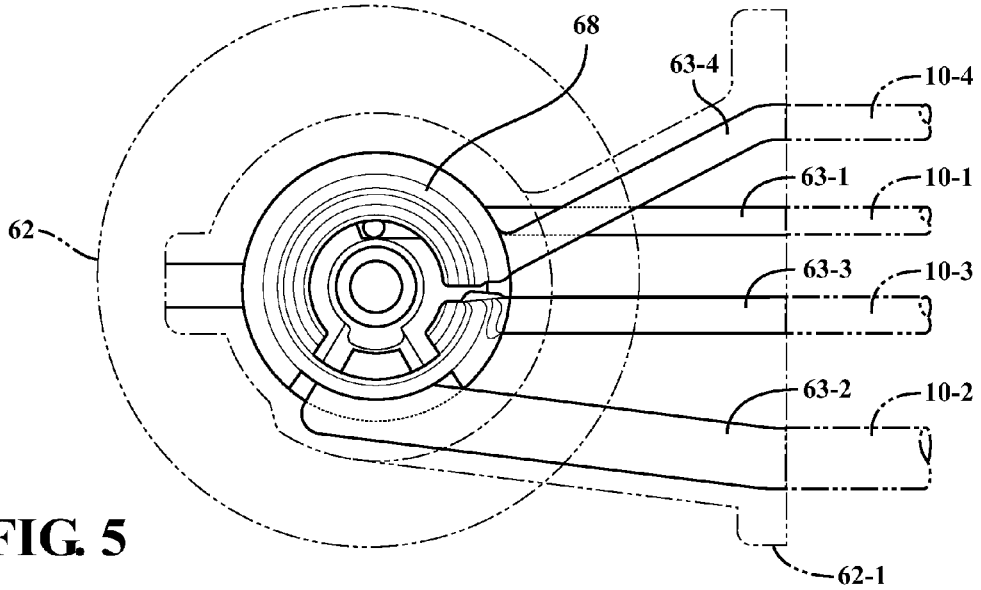
FIG. 5 is a close up side view of a bearing housing for the turbocharger shown in FIGS. 1-4, with the bearing housing having oil and coolant feed openings in the mounting flange.
Figure 6:
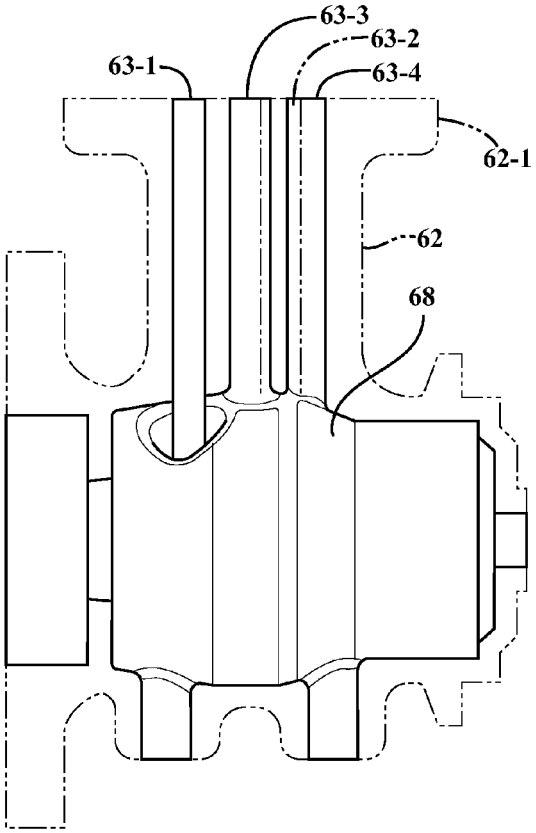
FIG. 6 is a close up top view of the bearing housing shown in FIG. 5.

Referring to the drawings wherein like reference numbers correspond to like or similar components throughout the several figures, FIG. 1 illustrates an internal combustion engine 10. The engine 10 also includes a cylinder block 12 with a plurality of cylinders 14 arranged therein. The engine 10 may define an oil supply passage 10-1, an oil return passage 10-2, a coolant supply passage 10-3, and a coolant return passage 10-4 (shown in FIGS. 5-6).

As shown in FIG. 1, the engine 10 also includes a cylinder head 16 that is mounted on the cylinder block 12. The oil supply passage 10-1, oil return passage 10-2, coolant supply passage 10-3, and coolant return passage 10-4 may be defined by either the cylinder block 12 or the cylinder head 16. Each cylinder 14 includes a piston 18 configured to reciprocate therein. Combustion chambers 20 are formed within the cylinders 14 between the bottom surface of the cylinder head 16 and the tops of the pistons 18. As known by those skilled in the art, each of the combustion chambers 20 receives fuel and air from the cylinder head 16 that form a fuel-air mixture for subsequent combustion inside the subject combustion chamber. The cylinder head 16 is also configured to exhaust post-combustion gasses from the combustion chambers 20.

The engine 10 also includes a crankshaft 22 configured to rotate within the cylinder block 12. The crankshaft 22 is rotated by the pistons 18 as a result of an appropriately proportioned fuel-air mixture being burned in the combustion chambers 20. After the air-fuel mixture is burned inside a specific combustion chamber 20, the reciprocating motion of a particular piston 18 serves to exhaust post-combustion gases 24 from the respective cylinder 14. The engine 10 also includes an oil pump 26. The oil pump 26 is configured to supply pressurized engine oil 28 to various bearings, such as that of the crankshaft 22. The oil pump 26 may be driven directly by the engine 10, or by an electric motor (not shown).

Figure 2:
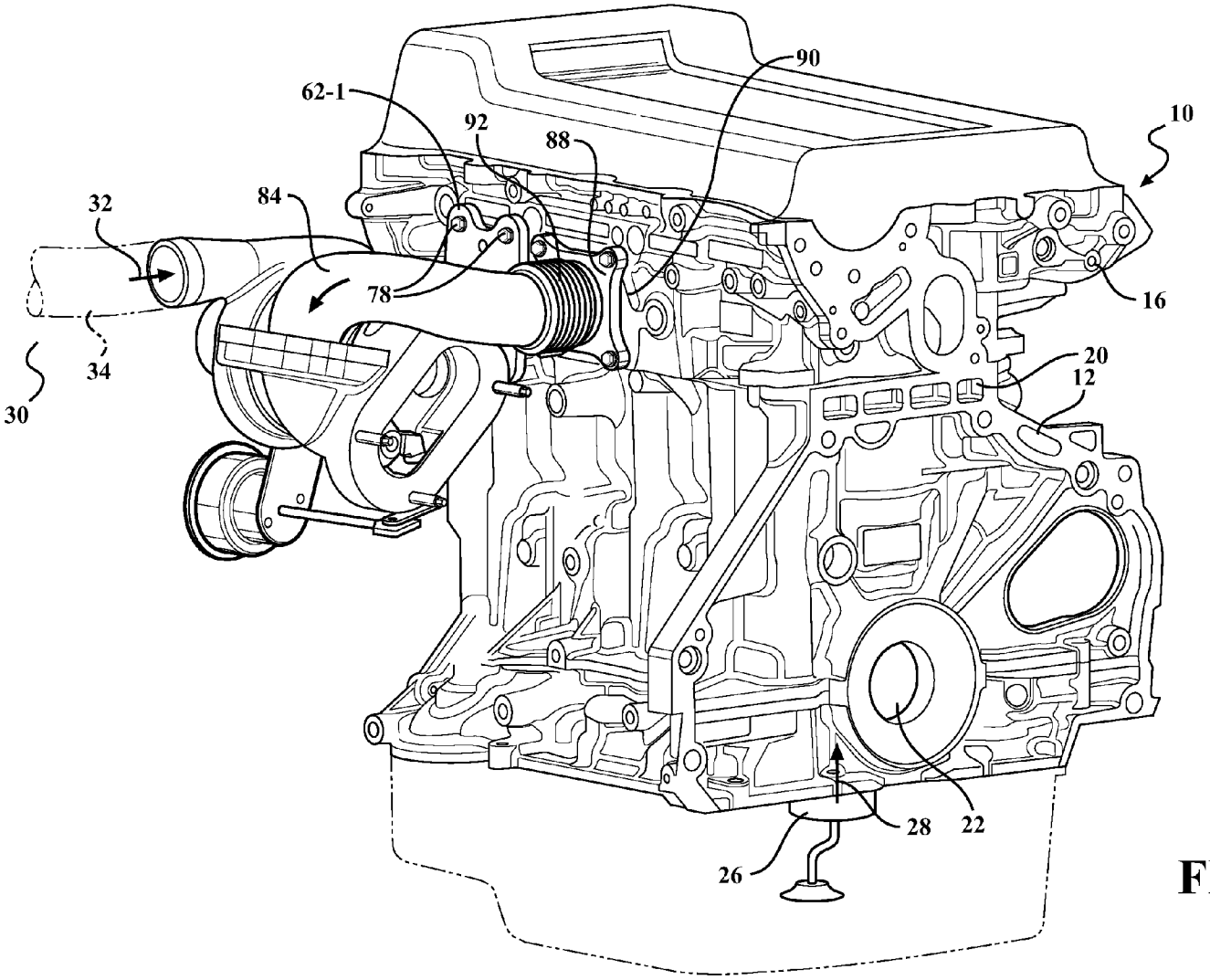
FIG. 2 is a perspective view of an engine with a turbocharger according to another embodiment of the disclosure.

The engine 10 additionally includes an induction system 30 configured to channel an airflow 32 from the ambient to the cylinders 14. The induction system 30 includes an intake air duct 34, a turbocharger 36, and an intake manifold (not shown). Although not shown, the induction system 30 may additionally include an air filter upstream of the turbocharger 36 for removing foreign particles and other airborne debris from the airflow 32. The intake air duct 34 is configured to channel the airflow 32 from the ambient to the turbocharger 36, while the turbocharger is configured to pressurize the received airflow, and discharge the pressurized airflow to the intake manifold. The intake manifold in turn distributes the previously pressurized airflow 32 to the cylinders 14 for mixing with an appropriate amount of fuel and subsequent combustion of the resultant fuel-air mixture. FIG. 1 shows one embodiment of the engine 10 having the turbocharger 36 mounted to the cylinder block 12, while FIG. 2 shows an alternative embodiment of the engine 10 having the turbocharger 36 mounted to the cylinder head 16.

Figure 3:
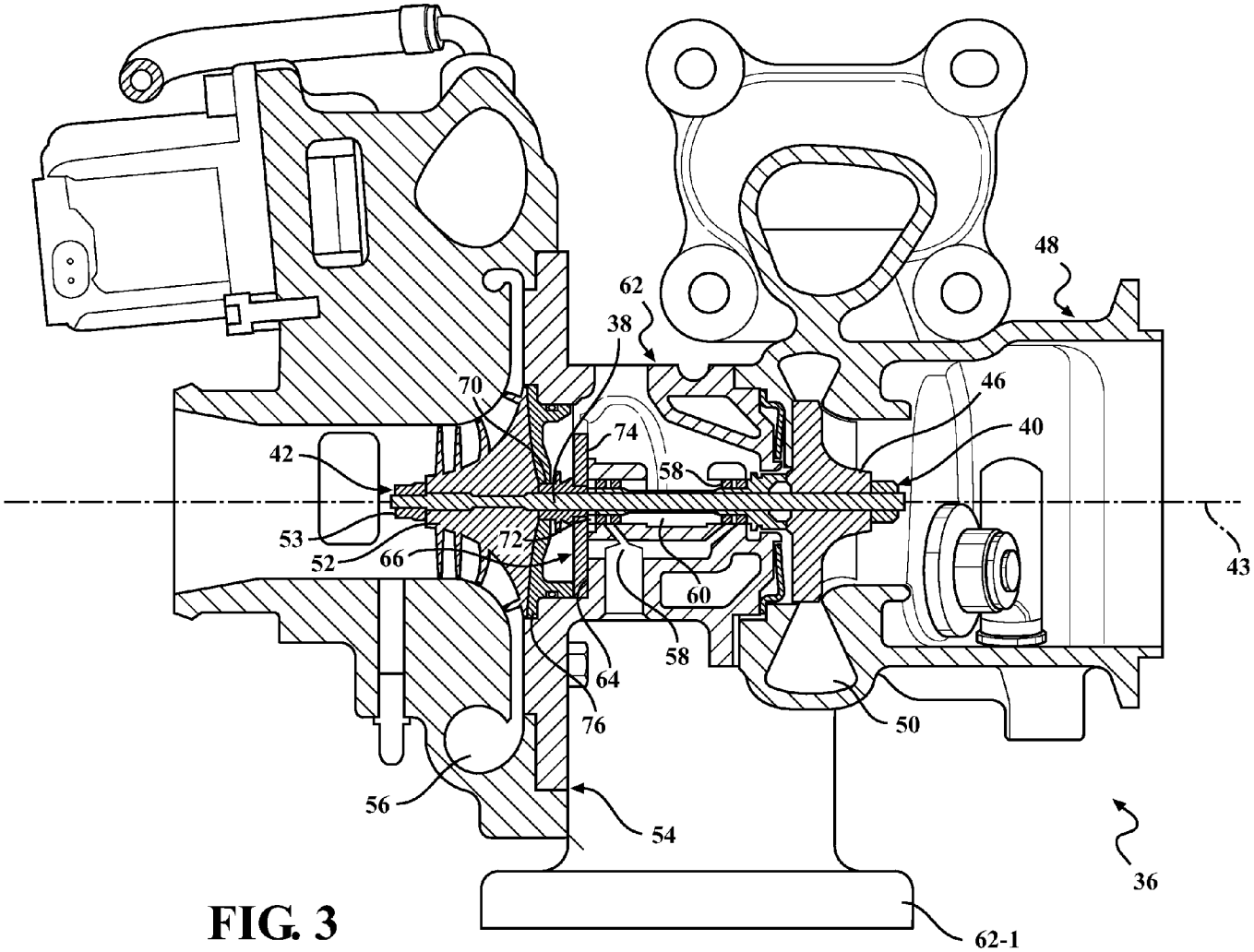
FIG. 3 is a partial cross-sectional view of the turbocharger shown in FIGS. 1-2.

As shown in FIG. 3, the turbocharger 36 may include a rotating assembly 37. The rotating assembly 37 includes a shaft 38 having a first end 40 and a second end 42. The rotating assembly 37 also includes a turbine wheel 46 mounted on the shaft 38 proximate to the first end 40 and configured to be rotated along with the shaft 38 about an axis 43 by post-combustion gasses 24 emitted from the cylinders 14. The turbine wheel 46 is typically formed from a temperature and oxidation resistant material, such as a nickel-chromium-based "inconel" super-alloy to reliably withstand temperatures of the post-combustion gasses 24, which in some engines may approach 2,000 degrees Fahrenheit. The turbine wheel 46 is disposed inside a turbine housing 48 that includes a turbine volute or scroll 50. The turbine scroll 50 receives the post-combustion exhaust gases 24 and directs the exhaust gases to the turbine wheel 46. The turbine scroll 50 is configured to achieve specific performance characteristics, such as efficiency and response, of the turbocharger 36.

As further shown in FIG. 3, the rotating assembly 37 also includes a compressor wheel 52 mounted on the shaft 38 between the first and second ends 40, 42. The compressor wheel 52 is retained on the shaft 38 via a specially configured fastener, such as a jam nut 53. As understood by those skilled in the art, a jam nut 53 is a type of a fastener that includes pinched or unequal thread pitch internal threads to engage external threads of a mating component, for example the shaft 38. Such a thread configuration of the jam nut 53 serves to minimize the likelihood of the jam nut coming loose from the shaft 38 during operation of the turbocharger 36. Additionally, the direction of the thread on the jam nut 53 may be selected such that the jam nut will have a tendency to tighten rather than loosen as the shaft 38 is spun up by the post-combustion gasses 24.

The compressor wheel 52 is configured to pressurize the airflow 32 being received from the ambient for eventual delivery to the cylinders 14. The compressor wheel 52 is disposed inside a compressor cover 54 that includes a compressor volute or scroll 56. The compressor scroll 56 receives the airflow 32 and directs the airflow to the compressor wheel 52. The scroll 56 is configured to achieve specific performance characteristics, such as peak airflow and efficiency of the turbocharger 36. Accordingly, rotation is imparted to the shaft 38 by the post-combustion exhaust gases 24 energizing the turbine wheel 46, and is in turn communicated to the compressor wheel 52 owing to the compressor wheel being fixed on the shaft. As understood by those skilled in the art, the variable flow and force of the post-combustion exhaust gases 24 influences the amount of boost pressure that may be generated by the compressor wheel 52 throughout the operating range of the engine 10. The compressor wheel 52 is typically formed from a high-strength aluminum alloy that provides the compressor wheel with reduced rotating inertia and quicker spin-up response.

With continued reference to FIG. 3, the rotating assembly 37 is supported for rotation about the axis 43 via journal bearings 58. The journal bearings 58 are mounted in a bore 60 along the axis 43 within a bearing housing 62 and is lubricated and cooled by the supply of pressurized engine oil 28 supplied via the pump 26. The bearing housing 62 may be formed from a suitable robust material, such as an aluminum-silicon alloy or a nodular cast iron, that can withstand appropriate thermal and mechanical stresses, and maintain dimensional stability of the bore 60 for operational support of the rotating assembly 37. The journal bearings 58 are configured to control radial motion and vibrations of the shaft 38. As shown, the journal bearings 58 may be fully-floating or a semi-floating type that are formed from a relatively soft metal, for example brass or bronze, such that any debris that passes through the bearing system would become embedded in the soft bearing material and not damage the shaft 38 or the bore 60. The journal bearings 58 may also be configured as roller or ball bearings to further reduce turbocharger frictional losses during rotation of the shaft 38.

As shown in FIG. 3, the bearing housing 62 includes a thrust wall 64. Additionally, the turbocharger 36 includes a thrust bearing assembly 66. The thrust bearing assembly 66 is configured to absorb thrust forces generated by the rotating assembly 37 while the turbocharger 36 is pressurizing the airflow 32. The thrust bearing assembly 66 includes a thrust collar 70 and a thrust washer 72. The thrust bearing assembly 66 also includes a thrust plate 74 that is held in place by a thrust retainer 76 against the thrust wall 64. The bearing surface of the thrust plate 74 is typically formed from a relatively soft metal, for example brass or bronze, such that any debris that passes through the bearing system would become embedded in the soft bearing material and not damage the thrust collar 70 or the thrust washer 72. The thrust retainer 76 may be held in place by a clip, one or more bolts, or otherwise attached to the housing 62 in order to hold the thrust bearing assembly 66 securely against the thrust wall 64.

During operation of the turbocharger 36, the pressurized engine oil 28 from the pump 26 is delivered to the bearing housing 62. Inside the bearing housing 62, the pressurized engine oil 28 is directed via dedicated cast passages to lubricate the thrust bearing assembly 66 and generate an oil film between the thrust washer 72 and the thrust plate 74. Such an oil film serves to reduce the likelihood of direct physical contact between the thrust washer 72 and the thrust plate 74. In turn, such reduction of direct contact between the thrust washer 72 and the thrust plate 74 serves to extend useful life of the thrust bearing assembly 66 and, accordingly, the durability of the turbocharger 36.

Figure 4:
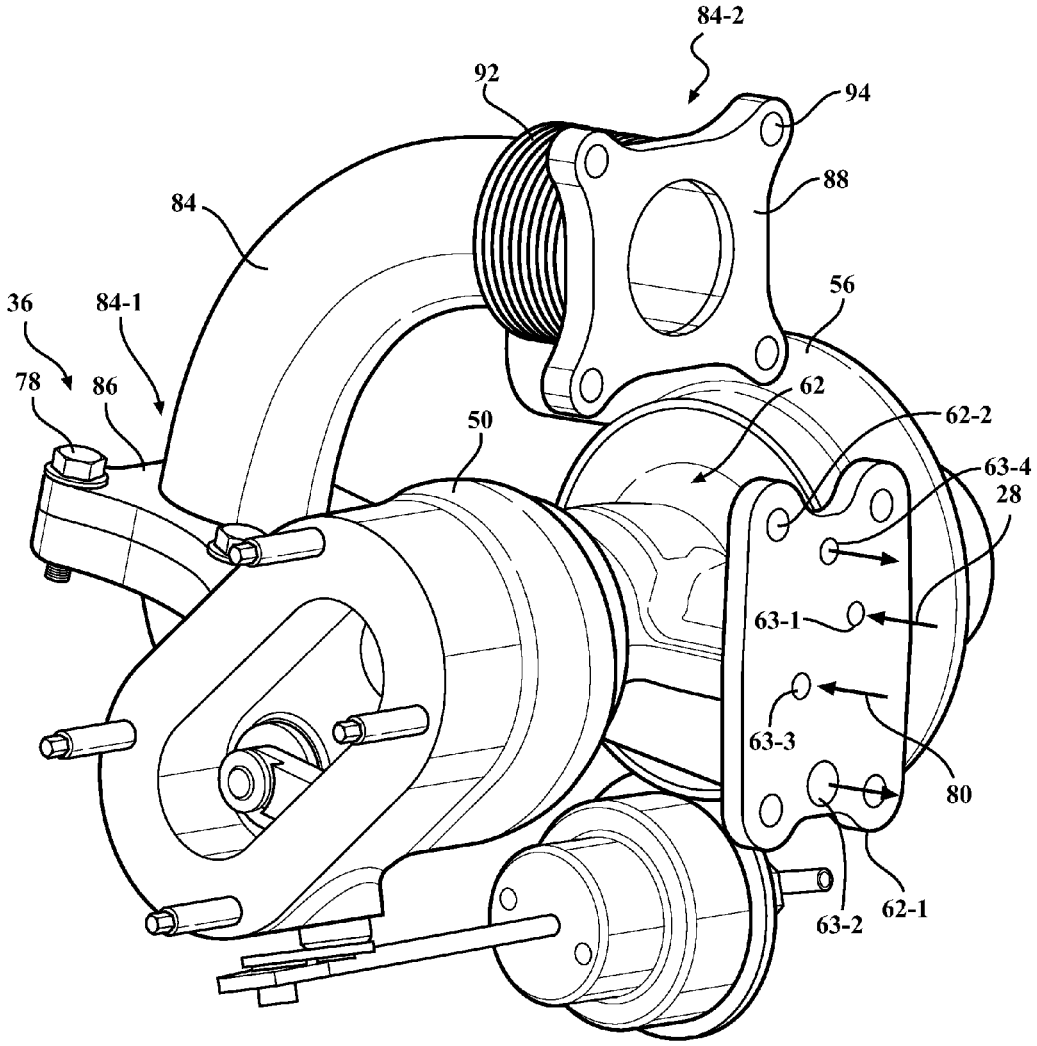
FIG. 4 is a perspective view of the turbocharger shown in FIG. 1 showing a mounting flange according to the disclosure.

As shown in each of the FIGS. 3 and 4, the bearing housing 62 includes a mounting flange 62-1 configured for direct mounting to either the cylinder block 12 (shown in FIG. 1) or to the cylinder head 16 (shown in FIG. 2). As shown in FIG. 4, the mounting flange 62-1 may define a plurality of apertures 62-2, each configured to accept a fastener 78 for reliable attachment of the bearing housing 62 to the cylinder block 12 or to the cylinder head 16. The mounting flange 62-1 defines an oil feed opening 63-1 configured to match up or correspond to the oil supply passage 10-1 and direct the oil to the journal bearing 58 and the thrust bearing assembly 66 when the mounting flange is attached to either the cylinder block 12 or the cylinder head 16. The mounting flange 62-1 also defines an oil return opening 63-2 configured to match up to the oil return passage 10-2 and remove the oil from the bearing housing 62 after the oil has been circulated therethrough and lubricated the journal bearing 58 and the thrust bearing assembly 66. The pressurized oil 28 is directed to the bearing housing 62 via the oil supply passage 10-1 to lubricate the journal bearings 58 and the thrust bearing assembly 66. Following the oil exiting the bearing housing 62 via the oil return opening 63-2, the oil goes back to the engine 10 via the oil return passage 10-2 to the oil pump 26.

The mounting flange 62-1 also defines a coolant feed opening 63-3 configured to match up to the coolant supply passage 10-3 when the mounting flange is attached to either the cylinder block 12 (shown in FIG. 1) or the cylinder head 16 (shown in FIG. 2). As shown in FIG. 4, the coolant feed opening 63-3 directs a coolant 80 to a water jacket 68 (shown in FIGS. 5-6) that is formed inside the bearing housing 62 proximate to the journal bearings 58 and the thrust bearing assembly 66. The coolant 80 absorbs and removes heat from the oil that had lubricated the journal bearings 58 and the thrust bearing assembly 66. The mounting flange 62-1 additionally defines a coolant return opening 63-4 configured to match up to the coolant return passage 10-4 and remove the coolant 80 from the water jacket 68 after the coolant has been circulated therethrough. Following the coolant 80 exiting the bearing housing 62 via the coolant return opening 63-4, the coolant goes back to the engine 10 via the coolant return passage 10-4 to a coolant pump 82 (shown in FIG. 1). The coolant pump 82 is mounted on the engine 10 and may be either actuated electrically or driven mechanically by the engine itself to pressurize the coolant 80.

As shown in FIGS. 1, 2 and 4, the turbocharger assembly 36 additionally includes an exhaust connector pipe 84 configured to direct the post-combustion gasses 24 from the cylinder head 16 to the turbine scroll 50. The exhaust connector pipe 84 includes a first end 84-1 and a second end 84-2. A first connector flange 86 is positioned at the first end 84-1 and is attached to the turbine scroll 50 via a fastener, such as the fastener 78 shown in FIGS. 1, 2 and 4. A second connector flange 88 is positioned at the second end 84-2 and is configured for attachment at the cylinder head 16 to an exhaust manifold outlet 90 (shown in FIGS. 1-2) via fasteners 78. As to be understood from the fact that the engine 10 includes multiple cylinders 14, but only a single outlet 90, the exhaust manifold may be internally cast, i.e., integrated, into the cylinder head 16. Although the integrated exhaust manifold itself is not shown, the existence and configuration of such a manifold would be understood by those skilled in the art.

The exhaust connector pipe 84 includes a flexible coupling 92 positioned on the second end 84-2 and with the second connector flange 88 secured thereto. The flexible coupling 92 is configured to take up positioning variance between the cylinder head 16 and the turbine scroll 50, and the vibration generated by the engine 10 during its operation. The second connector flange 88 secured to the flexible coupling 92 defines a plurality of apertures 94, with each aperture configured to accept a fastener, such as the fastener 78 shown in FIGS. 1-2, for attachment of the turbocharger assembly 36 to the cylinder head 16. The flexible coupling 92 may be configured, i.e., designed and fabricated, as a corrugated pipe (shown in FIGS. 1, 2, and 3) or a mesh sleeve (not shown) from a suitable heat resistant material, such as stainless steel.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. An internal combustion engine comprising:

a cylinder block defining a cylinder;

a reciprocating piston disposed inside the cylinder;

a cylinder head mounted to the cylinder block and configured to supply an air-fuel mixture to the cylinder for combustion therein and exhaust post-combustion gasses therefrom;

an oil supply passage formed in at least one of the cylinder block and the cylinder head; and a turbocharger assembly configured to pressurize an airflow being received from the ambient for delivery to the cylinder, the turbocharger assembly including:

a bearing housing having a mounting flange configured to be mounted directly to the cylinder head to thereby establish fluid communication with the oil supply passage;

a journal bearing disposed along an axis within the bearing housing;

a rotating assembly supported by the journal bearing and configured to be rotated about the axis by the post-combustion gasses; and a thrust bearing assembly configured to absorb thrust forces generated by the rotating assembly when the airflow is being pressurized;

an exhaust connector pipe configured to direct the post-combustion gasses from the cylinder head to the rotating assembly and having a flexible coupling configured to take up vibration and positioning variance between the cylinder head and the turbocharger assembly;

wherein the mounting flange defines an oil feed opening configured to correspond to the oil supply passage and direct oil to the journal bearing and the thrust bearing assembly when the mounting flange is attached to the cylinder head.

2. The engine of claim 1, wherein the rotating assembly includes:

a shaft having a first end and a second end, the shaft being supported by the journal bearing for rotation about the axis;

a turbine wheel fixed to the shaft proximate to the first end and configured to be rotated about the axis by the post-combustion gasses; and a compressor wheel fixed to the shaft proximate to the second end and configured to pressurize the airflow being received from the ambient for delivery to the cylinder;

wherein:

the turbine wheel is disposed inside a turbine housing having a turbine scroll;

the compressor wheel is disposed inside a compressor cover having a compressor scroll; and the compressor scroll and the turbine scroll are each attached to the bearing housing.

3. The engine of claim 2, wherein the exhaust connector pipe is configured to direct the post-combustion gasses from the cylinder head to the turbine scroll.

4. The engine of claim 3, wherein the cylinder head includes an integrated exhaust manifold having a mounting surface, and wherein the exhaust connector pipe is configured to attach to the cylinder head at the mounting surface.

5. The engine of claim 1, wherein the exhaust connector pipe includes a connector flange secured at the flexible coupling and defining a plurality of apertures configured to accept fasteners for attachment of the turbocharger assembly to the cylinder head.

6. The engine of claim 1, wherein the flexible coupling is configured as one of a corrugated pipe and a mesh sleeve.

7. The engine of claim 1, further comprising a coolant supply passage, a coolant pump configured to pressurize coolant, and an oil pump configured to pressurize the oil;

wherein:

the bearing housing includes a coolant jacket arranged proximate to each of the journal bearing and the thrust bearing assembly;

the mounting flange additionally defines a coolant feed opening configured to match up to the coolant supply passage when the mounting flange is attached to one of the cylinder block and the cylinder head and supply the coolant to the coolant jacket;

the pressurized oil is directed to the bearing housing via the oil supply passage to lubricate the journal bearing and the thrust bearing assembly; and the coolant is directed to the bearing housing via the coolant supply passage to absorb and remove heat from the oil that lubricates the journal bearing and the thrust bearing assembly.

8. The engine of claim 1, wherein the mounting flange defines a plurality of apertures configured to accept fasteners for attachment of the bearing housing to one of the cylinder block and the cylinder head.

9. The engine of claim 1, wherein the bearing housing is formed from an aluminum alloy.

10. A turbocharger assembly for pressurizing an airflow that is received from the ambient for delivery to an internal combustion engine having a cylinder head mounted to a cylinder block that defines a cylinder, a reciprocating piston disposed inside the cylinder, and an oil supply passage formed in at least one of the cylinder block and the cylinder head, wherein the cylinder head is configured to supply an air-fuel mixture to the cylinder for combustion therein and exhaust post-combustion gasses therefrom, the turbocharger assembly comprising:

a bearing housing having a mounting flange configured to be mounted directly to the cylinder head;

a journal bearing disposed along an axis within the bearing housing;

a rotating assembly supported by the journal bearing and configured to be rotated about the axis by the post-combustion gasses; and a thrust bearing assembly configured to absorb thrust forces generated by the rotating assembly when the airflow is being pressurized;

an exhaust connector pipe configured to direct the post-combustion gasses from the cylinder head to the rotating assembly and having a flexible coupling configured to take up vibration and positioning variance between the cylinder head and the turbocharger assembly;

wherein the mounting flange defines an oil feed opening configured to correspond to the oil supply passage and direct oil to the journal bearing and the thrust bearing assembly when the mounting flange is attached to the cylinder head.

11. The turbocharger assembly of claim 10, wherein the rotating assembly includes:

a shaft having a first end and a second end, the shaft being supported by the journal bearing for rotation about the axis;

a turbine wheel fixed to the shaft proximate to the first end and configured to be rotated about the axis by the post-combustion gasses; and a compressor wheel fixed to the shaft proximate to the second end and configured to pressurize the airflow being received from the ambient for delivery to the cylinder;

wherein:

the turbine wheel is disposed inside a turbine housing having a turbine scroll;

the compressor wheel is disposed inside a compressor cover having a compressor scroll; and the compressor scroll and the turbine scroll are each attached to the bearing housing.

12. The turbocharger assembly of claim 11, wherein the exhaust connector pipe is configured to direct the post-combustion gasses from the cylinder head to the turbine scroll.

13. The turbocharger assembly of claim 12, wherein the cylinder head includes an integrated exhaust manifold having a mounting surface, and wherein the exhaust connector pipe is configured to attach to the cylinder head at the mounting surface.

14. The turbocharger assembly of claim 10, wherein the exhaust connector pipe includes a connector flange secured at the flexible coupling and defining a plurality of apertures configured to accept fasteners for attachment of the turbocharger assembly to the cylinder head.

15. The turbocharger assembly of claim 10, wherein the flexible coupling is configured as one of a corrugated pipe and a mesh sleeve.

16. The turbocharger assembly of claim 10, wherein:

the engine additionally includes a coolant supply passage, a coolant pump configured to pressurize coolant, and an oil pump configured to pressurize the oil;

the bearing housing includes a coolant jacket arranged proximate to each of the journal bearing and the thrust bearing assembly;

the mounting flange additionally defines a coolant feed opening configured to match up to the coolant supply passage when the mounting flange is attached to one of the cylinder block and the cylinder head and supply the coolant to the coolant jacket;

the pressurized oil is directed to the bearing housing via the oil supply passage to lubricate the journal bearing and the thrust bearing assembly; and the coolant is directed to the bearing housing via the coolant supply passage to absorb and remove heat from the oil that lubricates the journal bearing and the thrust bearing assembly.

17. The turbocharger assembly of claim 10, wherein the mounting flange defines a plurality of apertures configured to accept fasteners for attachment of the bearing housing to one of the cylinder block and the cylinder head.

18. The turbocharger assembly of claim 10, wherein the bearing housing is formed from an aluminum alloy.

* * * * *